US007204470B2

(12) United States Patent
Jurik

(10) Patent No.: US 7,204,470 B2
(45) Date of Patent: Apr. 17, 2007

(54) TEXTURED MASONRY BLOCK MOLD & METHOD

(76) Inventor: Dean Jurik, 5131 N. 15 Rd., Mesick, MI (US) 49668

( * ) Notice: Subject to any disclaimer, the term of this patent is extended or adjusted under 35 U.S.C. 154(b) by 273 days.

(21) Appl. No.: 10/267,468

(22) Filed: Oct. 9, 2002

(65) Prior Publication Data

US 2003/0067096 A1 Apr. 10, 2003

Related U.S. Application Data

(60) Provisional application No. 60/328,368, filed on Oct. 9, 2001.

(51) Int. Cl.
*B28B 7/00* (2006.01)

(52) U.S. Cl. ..... 249/74; 249/119; 425/413; 425/441; 425/444

(58) Field of Classification Search ..... 249/52, 249/74, 117, 119; 425/412–413, 422, 441, 425/346, 444

See application file for complete search history.

(56) References Cited

U.S. PATENT DOCUMENTS

| | | | | |
|---|---|---|---|---|
| 3,940,229 | A | 2/1976 | Hutton | |
| 3,981,953 | A | 9/1976 | Haines | |
| 4,568,260 | A | 2/1986 | Paul et al. | |
| 4,627,764 | A | 12/1986 | Scheiwiller | |
| 5,078,940 | A | 1/1992 | Sayles | |
| 5,217,630 | A | 6/1993 | Sayles | |
| 5,249,950 | A * | 10/1993 | Woolford | 425/412 |
| 5,858,486 | A | 1/1999 | Metter et al. | |
| 5,879,603 | A | 3/1999 | Sievert | |
| 6,183,168 | B1 | 2/2001 | Woolford et al. | |
| 6,209,848 | B1 | 4/2001 | Bolles et al. | |
| 6,224,815 | B1 | 5/2001 | LaCroix et al. | |
| 6,349,522 | B1 | 2/2002 | Stevens | |

* cited by examiner

*Primary Examiner*—Yogendra Gupta
*Assistant Examiner*—Thu Khanh T. Nguyen
(74) *Attorney, Agent, or Firm*—Douglas S. Bishop

(57) ABSTRACT

A mold device and method for producing a rough texture on all or a portion of the outward exterior surfaces of masonry block units. The device of the present invention is a mold having one or more cavities, open at the top and the bottom, with a rigid support platform or sheet across the bottom, to hold the masonry mixture in place until discharged through the bottom of the mold. On a portion of the interior sidewalls of the mold, are substantially vertical ribs extending from the interior surface, creating voids in the compacted mixture. An extension or "stripper" unit extends inwardly along the base of the portion of the interior wall containing the vertical ribs. A top plate configured to fit removably within the interior walls of the mold cavity is provided to compact the masonry mixture and to push the masonry unit out of the mold and simultaneously clean the mold. As the masonry unit is pushed from the mold, the stripper extension or bar moves a portion of the compacted partially hardened masonry material, filling in the voids created and left by the ribs, and creating a textured surface.

20 Claims, 4 Drawing Sheets

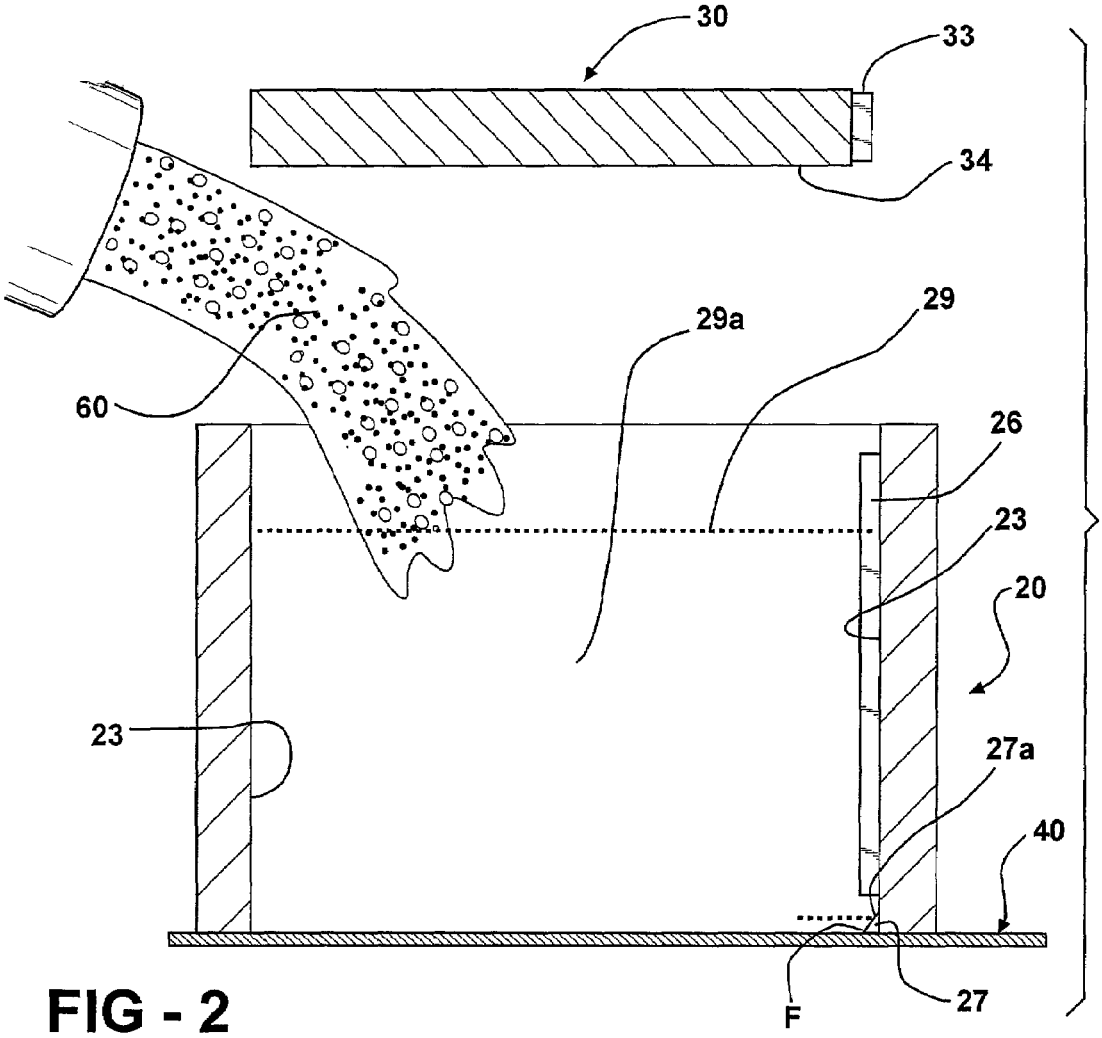
FIG - 2
FIG - 3
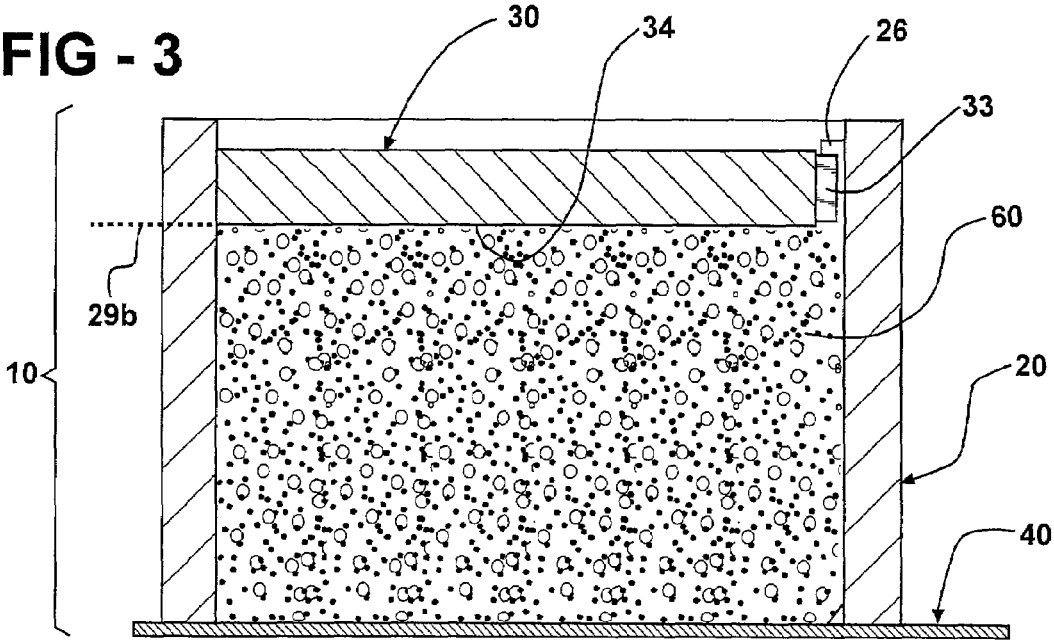

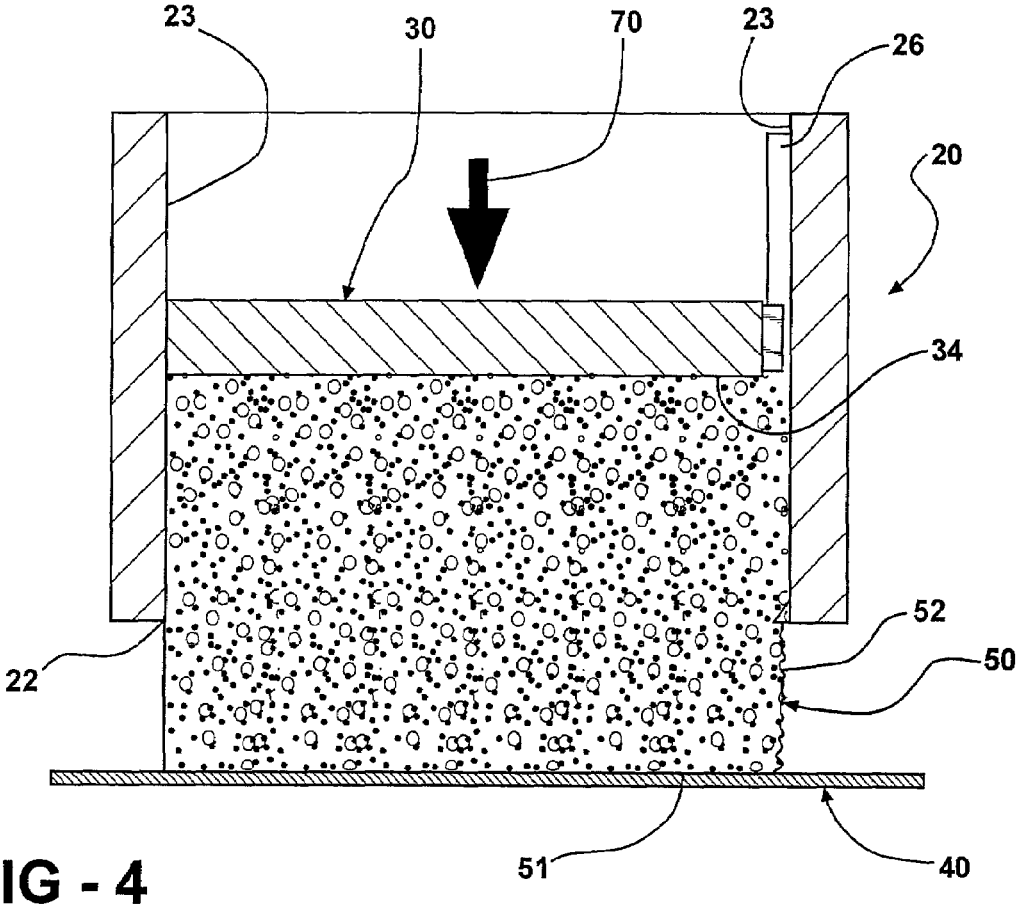
FIG - 4
FIG - 5
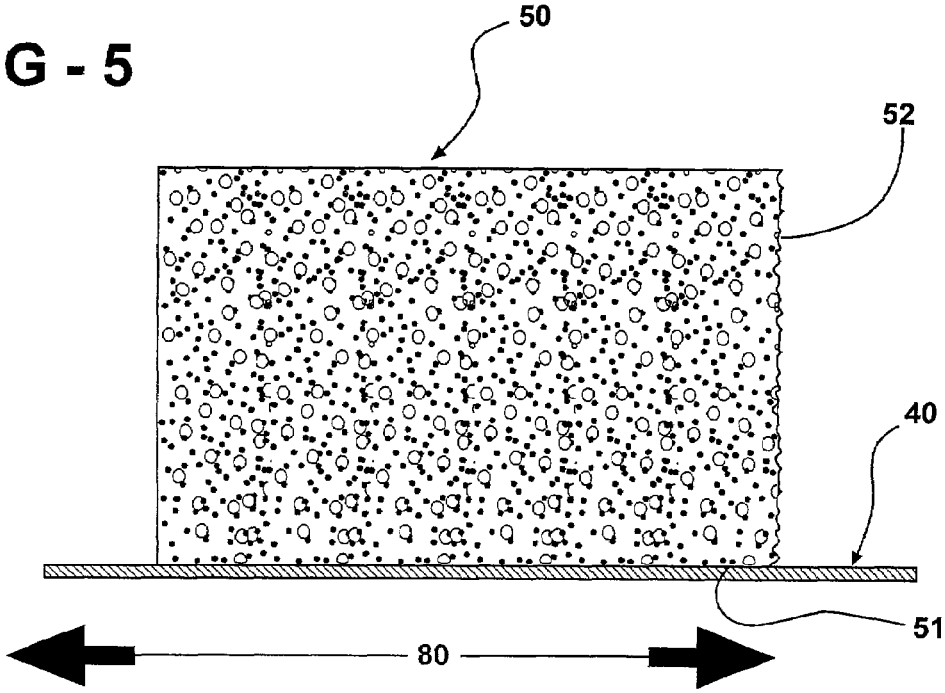

FIG - 6
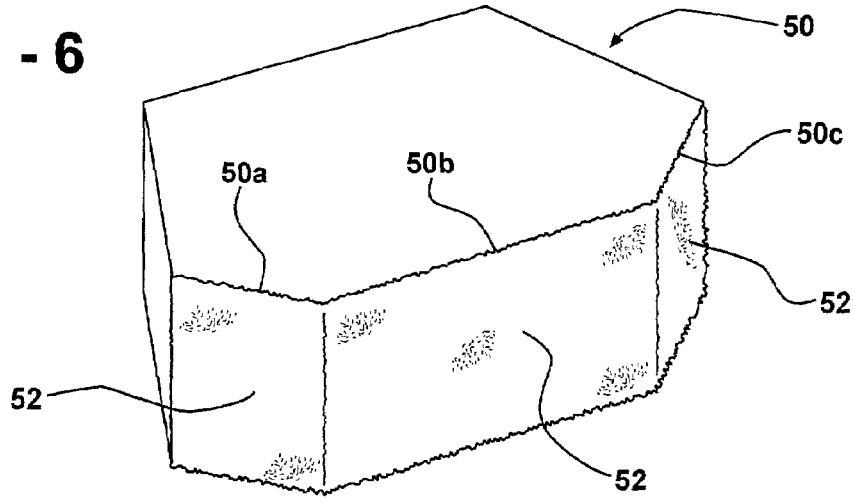
FIG - 7
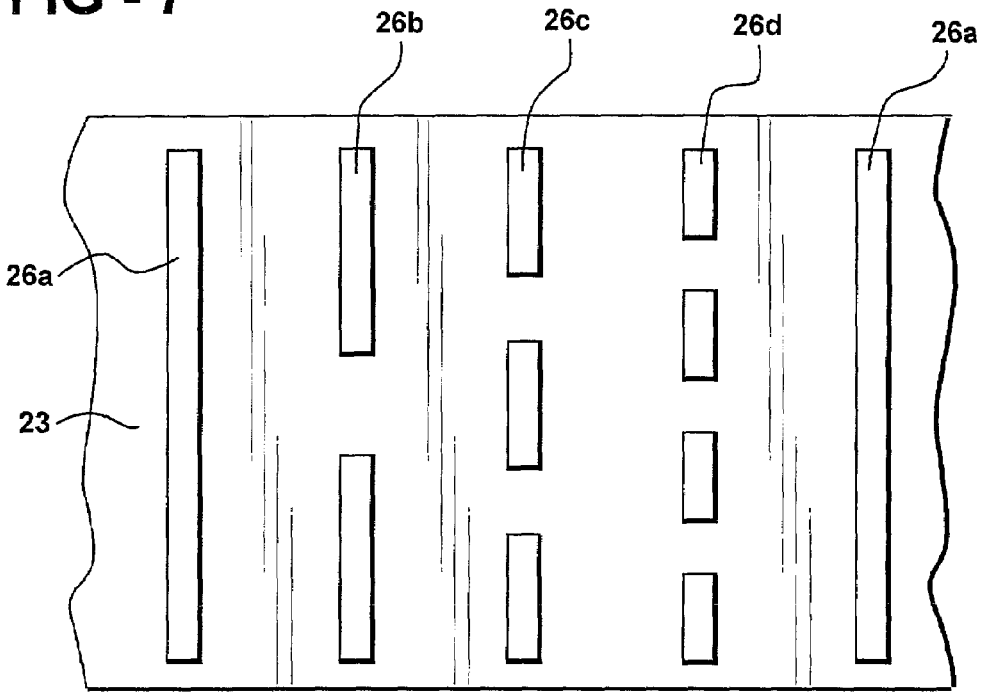
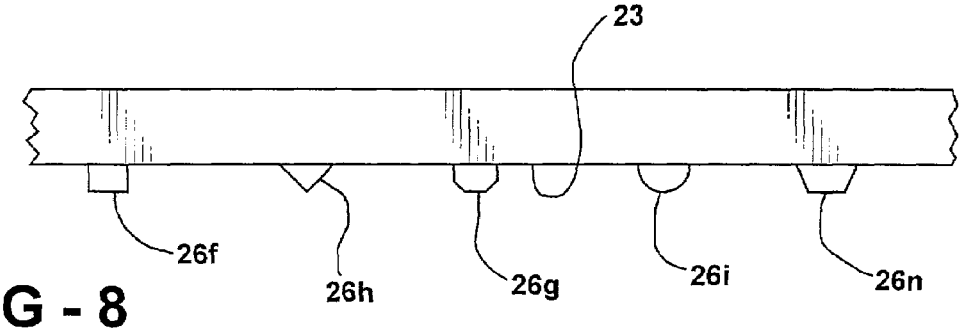
FIG - 8

TEXTURED MASONRY BLOCK MOLD & METHOD

This application claims benefit of provisional application 60/328,368 filed Oct. 9, 2001.

BACKGROUND OF THE INVENTION

The instant invention relates, generally, to the masonry block industry, and, more specifically, to a device and a method for producing a masonry block having a portion or all of its outwardly facing exterior surface of a textured nature.

The concept of creating a masonry block surface having a texture different than the flat, molded surface common in masonry, or concrete, blocks, is well known. Various techniques have been used to enhance masonry product appearance by creating, in some fashion, a textured surface, for more than a century. There are two generally accepted methods of creating a textured masonry surface. The surface can be created after the unit has been cured, known as "hard-split" or, the surface may be textured before the unit has cured, in a process sometimes known within the industry as "green-texturing."

The "hard-split" technique is well known, but has distinct disadvantages. The technique is costly, requiring the use of an expensive knife splitter, and an operator to constantly oversee the process. Such a technique also invariably slows down the production process and, inevitably, produces waste as the units are split. Because the units are cured, as of the split, the excess material is not re-utilized, and must be discarded. Further, the "hard-split" process is generally useful only in producing straight splits, and is difficult to utilize in a radial style split, without a great deal of modification effort and additional cost.

The process generally described a "green-texturing," was developed in an attempt to answer the high costs of labor and equipment by definition entailed in the "hard-split" process. A number of processes have previously been developed to attempt to address these problems. "Green-splitting" can occur in a number of methods, but may generally be classified into two categories, to wit: either texturing after the unit is discharged, outside of the mold and still in a "green" or plastic state, and texturing which is done within the mold, or by the very process of discharging the unit from the mold. Several earlier patents suggest processes which create a textured block surface after the block has been removed or stripped from the mold but before the block has been cured. In this "green" or uncured state (sometimes referred to within the industry as a "plastic" state—that is capable of being molded or receiving form), great care must be utilized in removing the unit from the mold, so as not to disturb the unit, in its fragile, plastic state, prior to curing outside of the mold. Although limited textures may clearly be applied utilizing these techniques, they require significant maintenance, and are limited in the amount of texture which may be added. Regular attention and maintenance are additionally required, to attempt to minimize the number of units that need be discarded because of improper texturing, or disintegration of the unit itself.

U.S. Pat. No. 3,981,953, to Haines, discloses a process whereby texture is applied within the mold, but only to the top or horizontal surface. Applying texture to the top surface limits the use of such a texturing process where the masonry units involved have connective or other features on the top and/or bottom surface which contribute to the functionality of the unit. Further, rods which hold material within the mold may leave marks in the unit detracting from its overall aesthetic appearance. The processes involved in the '953 patent allow for adaptation to a vertical surface, but not without significant effort and, likely, production problems.

U.S. Pat. No. 5,078,940, and U.S. Pat. No. 5,217,630, both to Sayles, are directed to solutions to the problems referenced above as being associated with former methods, as they create a textural vertical surface within the mold cavity. However, because material is retained within the mold between molding cycles, a cleaning problem is created wherein material must be removed, or voided out, in a separate step, on a regular basis. With regard to the '630 patent, another disadvantage is that, as material breaks away, there in an inclination to create an angled feature of the vertical face from top to bottom. While this may not be a significant disadvantage in very short units, such as those used for retaining walls, the textured portion of the block creating an angled face can cause significant problems in units having a longer vertical face and will likely preclude use for exterior surfaces on architectural building projects. Such a process also produces waste on the production pallet which must be removed in a separate operation.

U.S. Pat. No. 6,224,815, to LaCroix, et al, addresses the issue of cleaning away excess material created in the texturing process, as it provides a self-cleaning function when the supporting pallet comes in conjunction with the mold and its operating means. The process involved in the '815 patent utilizes a metal grate suspended between two units within the mold. The grate is suspended between two areas of compacted materials, so that, with each cycle, two units are produced. However, either an even number of units must be produced or a large amount of waste is produced by each cycle if the optimum layout contains an odd number of units. There may also be waste extruded or dropped onto the production pallet. Further, streaks may develop in the finished product utilizing the process described in the '815 patent, as materials trapped within the open parts of the grates can smear against the upper face of the units.

U.S. Pat. No. 3,940,229, to Hutton, U.S. Pat. No. 5,879,603, to Sievert, and U.S. Pat. No. 6,209,848, to Bolles, et al, all disclose variations of what may be described as a "lip" system. As disclosed in the '229 and '848 patents, a single lip or striker at the bottom of the mold strips the material from the face of the unit as the unit is discharged. The '603 patent discloses a two lip system, one at the bottom of the mold and one at the top of the compacted unit. Both the device of the '848 patent and that of the '229 patent still tend to force materials to "smear" on the upper portion of the units, particularly units of greater height, as sufficient room is not allocated within the block itself to receive material which has been stripped or accordingly removed by the striker or "lip" as it pulls material away from the unit creating the textured surface below. The '603 patent retains material within the mold between the upper and lower lip similar to that of the process disclosed by the '603 patent, but, as is the case with the '229 and '848 patents, this process also may create a material smear on the upper portions of units of any significant height. All processes disclosed by the referenced prior art tend to leave material on the production pallet.

The problems generally associated with the existing art in "green-texturing" techniques, in the way of leaving "green" material on the pallet or supporting platform, the requirement of regular cleaning of the mold, textured face surfaces which are angled or substantially deviated from the vertical, particularly in taller units, and smudged or smeared material on units beyond those of minimum height, are all results of the reaction which takes place when material is torn away from the "green textured" unit surface when the material is forced out of the mold, or a scraper or striker unit or bar extends into or moves against a significant portion of the unit surface. An overlaying or smearing effect which is prevalent in many of the applications of the prior art, is produced when material moves only in a vertical direction, and compounds upon itself or is left within the mold when the masonry unit is discharged. The prior art does not disclose any satisfactory method for disposition of excess material without retaining it within the mold enclosure or upon the pallet or support plate below the mold. As is evident, the prior art provides only for continued movement of material vertically against the face of the masonry unit.

Accordingly, a need exists for a mold device and method which allows displacement and movement of excess material produced during the process, during each cycle of manufacture of units, and, in so doing, creates an opportunity for, and forces, lateral as well as vertical movement of such material. It is an intended feature of the instant device and method, to eliminate the problems associated with the prior art, as set forth above and, in so doing, to produce a random and rough texture on the masonry unit, without a smearing effect, and without leaving substantial excess material within the unit, or upon the supporting platform.

The present invention is further addressed to a need, as is evident from a review of the prior art, for a device and process which may be used on surfaces for retaining wall units, architectural masonry units, paving units and any number of other masonry products which are molded and for which an exterior textured surface is desirable.

SUMMARY OF INVENTION

The present invention is directed to the provision of a mold assembly, and process and method, to produce a masonry unit having a rough or textured surface on a portion of, or all of, its exterior vertical face. More specifically, the invention is directed to provision of a mold unit, which sits on a moveable, supporting sheet or pallet, wherein masonry material is poured or injected through the open top of the mold. The top of the mold is covered, with a rigid cover unit, the outward exterior dimension of which roughly approximates the interior dimensions of the mold unit. The top or cover is used to compact the masonry material once poured into the mold, and then forces the "green," or uncured, masonry unit through the mold and out the bottom, forcing the unit on the supporting pallet downward. On a portion of the interior sidewalls, which, if the mold unit is polygonal, such portion will comprise one or more of the separate sides, a number of substantially vertical ribs are provided, beginning near the bottom of the sidewall and running substantially parallel to the top. Generally, there will be a number of such ribs, each of a dimension sufficient to create a substantial void within a portion of the masonry material as it is compressed. Substantially beneath the portion of the interior sidewall to which the protruding ribs are attached, along its bottom, and extending inward, is a projection, or "stripper" bar, which is proximate to and runs substantially parallel to the bottom of the interior sidewall.

As stated, the top of the mold unit, which fits within the interior cavity, is conformed to substantially correspond to the interior dimension of the mold wall. Accordingly, the top will have indentations along its outer edge substantially corresponding with the ribs which are provided on the interior wall. To the extent that the ribs, though substantially vertical, may not be absolutely vertical, or absolutely parallel, the corresponding opening for any rib in the inserted top of the unit may be somewhat larger than the actual rib protrusion to accommodate any reasonable deviation.

The substantial conformity of the exterior dimension of the top, with the interior dimension of the mold walls, also provides a cleaning function when the top of the mold is inserted and pushed downward, as it prevents any substantial amount of masonry material from being pushed around or over the cover unit as the masonry unit is pushed down and out of the mold.

In the preferred embodiment, the projection, or stripper bar, at the base of the mold projects inwardly in a dimension determined to scrape or move an amount of uncured masonry material roughly corresponding to the volume of the substantially vertical ribs.

The mold, and process provided by the instant invention may be utilized separately, with any manner or means of force utilized to insert the cover into the mold, to compact the masonry material, and to, thereafter, force the masonry material and unit out of the mold, and, in doing so, over the striker bar. The device and process is susceptible to singular manual use or utilization in conjunction with a conventional masonry products machine.

According to a preferred feature of the invention and process, the mold unit sits on a pallet or flat support plate. The cover is raised, or otherwise removed. A masonry mix, typically comprised of masonry cement, aggregate and water, is placed, by pouring or other injection, into the mold to a desired height. The mold may have one or a number of cavities. The mold cavities will also have a unitary inner surface, which may be in any unitary shape, but typically will be polygonal, with a specific number of sidewalls. They may, however, be circular or oblong.

The cover is inserted on and into the mold cavity, and pushed downward to a desired point, compressing the material to the desired consistency for further production.

At this point, the cover is pushed further downward, pushing the compacted masonry unit through, and eventually out of, the mold structure. The supporting pallet or plate moves downward as the masonry unit is pushed or discharged from the mold cavity.

According to a further feature of the invention and process, and key to its success, the substantially vertical ribs create voids in the compressed masonry material as the block is lowered. Further, the top plate, conformed to substantially correspond with the inner diameter of the mold, including indentations to accommodate the ribs, holds the upper portions of the masonry and material in place, simultaneously forcing it downward, and keeping the interior of the mold clean in the process. The striker bar at the base of the mold forces masonry material initially upward. However, although some material directly below the voids created by the ribs may go directly upward, other material, because of the resistence above it, is forced laterally and diagonally into the voids left by the ribs, creating the textured surface desired, but not requiring that excess material be left within the mold, or upon the supporting pallet or plate.

A further preferred feature of the invention is the ability to allow the contour of the striker bar, and the underside of the portion of the cover plate which fits between the projected ribs, to correspond in a manner which allows the cover plate to be fully inserted through the depth of the mold.

It is a further feature of the invention that, in the preferred embodiment, the horizontal ribs create voids of total volume, at least equal to or greater than, the volume of material to be displaced or moved by the downward movement of the masonry unit against the striker bar. That is, the intrusive dimension of the striker bar is determined correspondingly with the depth, and width, which creates the total volume of the ribs.

It is a further feature of the invention that, in placement of the ribs, which, in the preferred embodiment, are parallel and substantially vertical, some deviation from parallel conformity, and vertical conformity, may be tolerated and, in such case, the corresponding indentations on the cover plate for each of the respective ribs is of sufficient width to accommodate whatever deviation from the vertical the individual rib to which it conforms may have.

It is a further feature of the invention and process that, although the protrusion of the ribs, in the preferred embodiment, is rectangular, it may be triangular, semi-circular, or otherwise shaped, as may be desired to provide a different or desired texture.

It is a further feature of the invention and process that individual ribs may, themselves, be sectioned, and segmented, with spaces between the sections, to provide some movement of the masonry material, in advance of the striker bar, which may be desirable for a particular texture.

It is a further feature of the invention and process that the striker bar itself may be of different shapes and protections, and may or may not be uniform across its length, and may, if desired, not project in certain areas.

It is a further feature of the instant design and process that the texturing process may be applied, uniformly, to the entire side surfaces of the masonry unit, by ribs and striker bar, around the interior base of the mold, or to any particular side or sides, or portion thereof, of the side surfaces of the mold. The device and technique is equally susceptible to flat surfaces, as well as circular or radial surfaces.

As stated, the instant invention allows displacement and movement of excess masonry material, vertically, as well as simultaneously diagonally laterally, providing optimum use of all material, to produce a random and rough textured exterior masonry unit surface, utilizing substantially all of the masonry material displaced in the process.

The above and additional features of the invention may be considered and will become apparent in conjunction with the drawings in particular, and the detailed description which follow.

BRIEF DESCRIPTION OF THE DRAWINGS

The following detailed description is best understood by reference to the following drawings, in which:

FIG. 2 is a cross-sectional view of the mold structure showing a raised cover, support plate in place, and the step of the process wherein the masonry mixture is injected into the mold.

FIG. 3 is a side-sectional view of the mold, filled with masonry material, wherein the cover unit is in place, the base plate is in place, and the mason material has been compacted to the desired consistency.

FIG. 4 is a cross-sectional view of the mold, showing the cover forcing the unit, and base plate, downward and out of the mold, and demonstrating the texturing feature of the "striker bar" and the cleaning feature of the top plate.

FIG. 5 is a cross-section of a completed masonry unit, showing a textured front surface, resting on the base plate, said unit having been discharged from the mold, and moveable horizontally away from the mold.

FIG. 6 is a perspective view of a polygonal completed masonry block, having a textured surface on three different sides.

FIG. 7 is a cut-away view of a portion of the interior vertical surface of the mold, showing various alternative configurations of the projecting substantially vertical ribs.

FIG. 8 is a cut-away top view of a portion of the mold wall, showing the exterior surface, and the interior surface, showing the protruding ribs, demonstrating a variety of possible shapes and configurations of the ribs.

DETAILED DESCRIPTION OF THE PREFERRED EMBODIMENT

Figure 1:
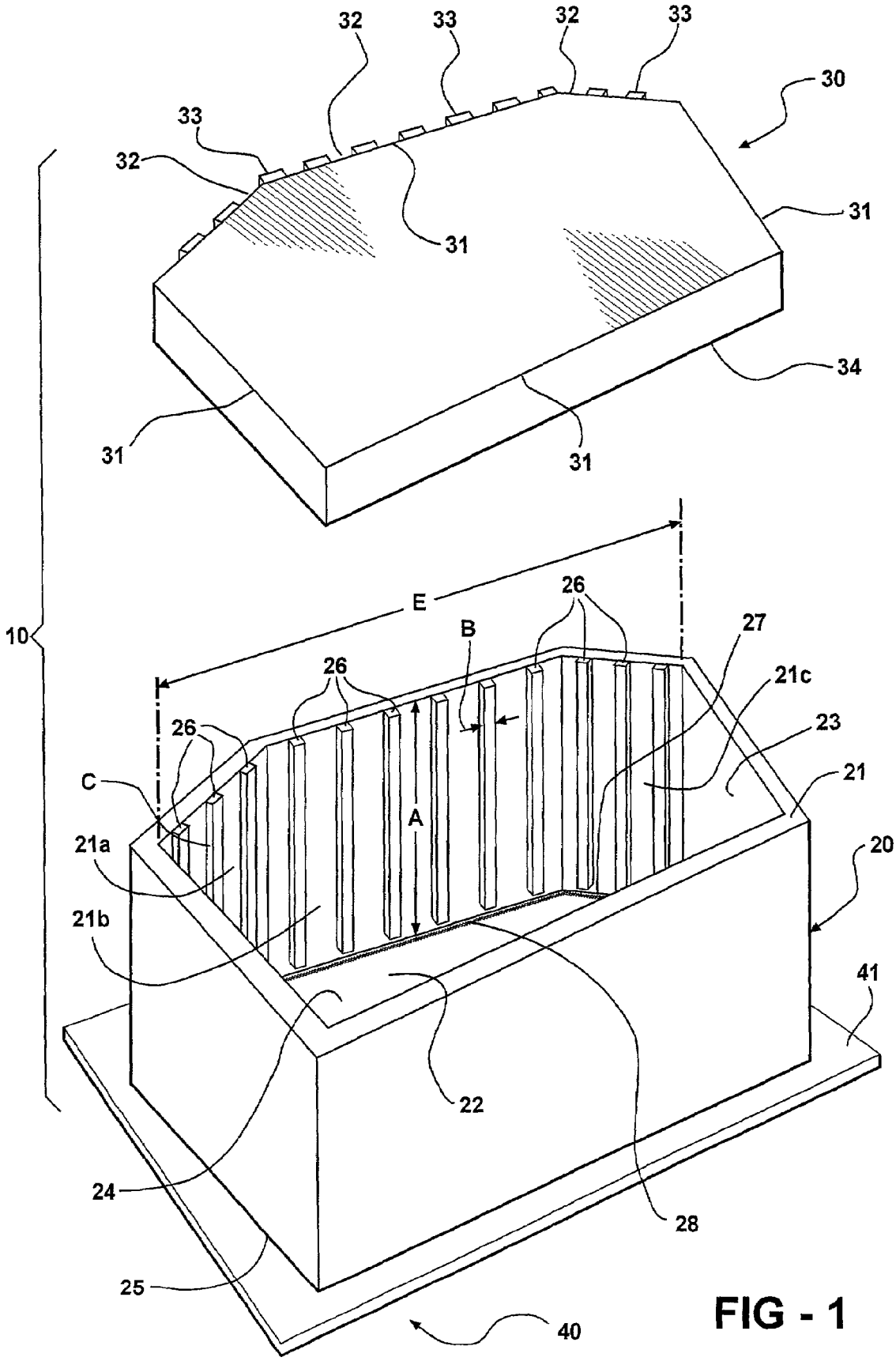
FIG. 1 is a perspective view of a preferred embodiment of the mold, sitting on a support plate, with its cover open.

Throughout the following detailed description, like numerals are used to reference the same element of the present invention, although the same may be shown in multiple figures thereof.

The invention textured masonry block mold and method, broadly considered, includes and incorporates a mold device 10, which includes a unitary wall structure member 20, a rigid cover structure 30 and a rigid base support surface 40.

The structure member 20 defines, by the enclosure of its unitary wall 21, a cavity 22, having a unitary inner surface 23. The defined cavity 22 may be polygonal, as shown in FIG. 1, or have radial dimensions in the way of an oval or circle. In any event, in the preferred embodiment, the inner surface 23 is substantially vertical. The defined cavity 22 has an open top 24 and an open base 25, which are both generally planar and approximately parallel.

A plurality of rib members 26 of a defined length A and defined width B extend inwardly a designated distance C over a portion E of the inner surface 23. This portion E is shown in FIG. 1 as being sides 21*a*, 21*b* and 21*c* of a polygonal structure member 20. In actual practice, the portion E of the inner wall 23 may be by designated sides, if polygonal, or simply a defined portion of inner surface 23. In any case, rib members 26 may be provided over up to the entire unitary surface of inner surface 23.

A planar cover structure 30 is provided with an exterior dimension 31 configured to fit conformably with the cavity 22 and to traverse within cavity 22 from its open top 24 until proximate to its open base 25. The exterior dimension 31 configuration includes a number of indentations 32 corresponding to each of the ribs 26, such indentations 32 creating apparent corresponding projections 33 on the exterior dimension 31 of cover 30 to allow extension between the ribs 26 until such projections 33 are proximate the inner surface 23 between the ribs 26.

While, in the preferred embodiment, ribs 26 are substantially vertical and parallel with each other, as shown in FIG. 1, deviation from the vertical between 0° and 45° may be permitted without departing from the spirit of the invention. Likewise, uniform parallel placement of ribs 26 is not a requirement.

When there is deviation of one or more ribs 26 from the vertical, however, the indentation 32 corresponding to a particular rib 26 must be of sufficient dimension to allow insertion of cover structure 30 and traverse from open top 24 to proximate open base 25. The relationship between a projection 33, a rib 26 and inner surface 23 is demonstrated in FIGS. 3 and 4. Because of the conformity feature of the cover 30 within the structure member 20, in particular in conformity with the ribs 26 and the proximity of the inner surface 23 therewith, in addition to compacting the plastic masonry material 60, as shown in FIG. 3, and moving the material 40 through the structure member 20, as shown in FIG. 4, the cover 30 also provides a self-cleaning function as further demonstrated in FIG. 4, by ensuring that no significant excess material 60 is left on the inner surface 23 above the cover 30.

As may be noted from FIG. 7, the rib members 26 may be continuous vertical projections 26*a*, segmented vertical projections 26*b*, 26*c* or 26*d*, or any combination thereof. Likewise, in cross-sectional dimension, as shown in FIG. 8, the ribs 26 may be rectangular 26*f*, otherwise polygonal 26*g*, triangular 26*h*, radial 26*i* or truncated 26*h*. In essence, the shape of the projecting ribs is not limited to any specific geometric form and may be varied as desirable for any resulting texture feature of the masonry unit 50.

Affixed to the inner surface 23 of the structure member 20, around and projecting inward around the open base 25, is an edge member 27. The edge member 27 is configured along the open base 25 corresponding to portion E which contains the plurality of ribs 26. As shown in FIG. 2, in the preferred embodiment, the upper surface 27*a* of the edge member 27 projects away from the inner surface 23 and downward from the horizontal at an approximate angle F of 45° but may be within any range of angle between 0° and 90° but preferably between 0° and 45°. As shown in FIG. 1, the edge member 27 may serrate at its outer edge 28. The dimension of projection of edge member 27 may vary along the portion E of the inner surface to which it is attached.

The device 10 also includes a support plate 40, generally rigid and with a planar surface 41 in a substantially parallel plane with the base opening 25 and the cover 30, when the cover 30 is inserted into structure member 20. The support plate remains in contact with structure 20 while the masonry material 60 is injected and compacted as shown in FIGS. 2 and 3 and is lowered concurrently maintaining contact with the base 51 of the masonry unit 50 as it is pushed from the structure member 20 by external force 70 on the cover 30. After unit 50 has been ejected from the structure member 20, it remains on support plate 40, and may be moved laterally in any desired direction by force 80, as shown in FIG. 5.

The mold device 10 as depicted above may be utilized with manual force or, alternatively, in conjunction with mechanical means, including, but not limited to, to a conventional masonry products machine.

In practice, the structure member 20 and support plate 40 are in contact with each other as described and shown in FIG. 2. The cover structure 30 is removed. Plastic masonry material 60 is injected into the structure unit 20 to a desired level 29 predicated upon desired volume 29*a*.

The cover unit 30 is then inserted into the cavity 22 of structure 20 and moved downwardly as shown in FIG. 3, until the plastic masonry mixture 60 is compacted to a desired consistency, determined by downward movement of cover 30 to a designated height or position 29*b*.

The cover 30 is then moved downward by force 70 in parallel with base opening 25 and support plate 40, and support plate 40 is concurrently lowered, until the base surface 34 of cover 30 is approximately even with base opening 25, thus ejecting a rough textured masonry unit 50 from the structure 20. The unit 50 remains on support plate 40 until it is moved thereon laterally by force 80.

During the process whereby the compressed masonry mixture 60 is forced downward through structure 20, voids are left in the mixture 60, as the mixture is pushed below the projections of the ribs 26. The edge member 27 projects into the cavity 22 and forces the material above it to remain above the edge member 27 as the unit 50 is pushed through the structure. This portion of the material is pushed vertically, diagonally and laterally over the unit surface 52, filling at least in part the voids left by the ribs 26.

In the preferred embodiment of the invention, the displacement of the ribs 26 within the volume 29*a* of the compacted material 60 is approximately equal to the amount of compacted material 60, above the edge member 27 and below cover 30, along the portion E of the inner surface 23.

The ejected unit 50 may be cured before or after movement away from the structure member.

FIG. 6 demonstrates a polygonal masonry unit 50, produced by the instant device and method, with a textured surface 52 on three sides 50*a*, 50*b* and 50*c*.

What is claimed is:

1. A mold device for producing a textured-face masonry unit, comprising:

a unitary wall structure member, defining, by enclosure, a cavity and interior surface of defined interior dimension, said cavity having an open base and open top, wherein masonry material is received through said open top and a molded masonry unit is discharged through said open base;

a plurality of rib members of defined length and width attached to at least a portion of the interior surface of the mold cavity and extending inwardly a defined distance into the mold cavity from the interior surface and vertically extending between the base and the top of the structure member;

a removable substantially planar rigid cover structure having an outer dimension conforming to and insertable within and substantially through the mold cavity, said conforming outer dimension further defining a plurality of indentations corresponding to the respective inwardly extensions of the plurality of rib members;

an edge member of defined dimension affixed to the interior surface of the mold cavity at the base of the mold cavity extending from the interior surface into the mold cavity and extending along said base for at least the portion of the mold cavity upon which the plurality of rib members is attached; and a removable, generally planar rigid base support surface positioned proximate to the base of the mold structure and downwardly removable in correspondence with the discharge of a molded masonry unit, a plurality of exterior facing voids forming in the masonry material concurrent with its displacement along the interior surface and corresponding to the arrangement and location of said rib members, said edge member redirecting outermost portions of the material to fill at least a portion of the voids left by said rib members.

2. The mold device of claim 1, wherein the defined mold cavity is polygonal and said rib members are attached to one or more sides of said mold cavity.

3. The mold device of claim 1, wherein the planar cover structure is substantially parallel to the base of the mold cavity and the base support surface during insertion into and substantially through the mold cavity.

4. The mold device of claim 1, wherein the plurality of rib members extend between the base and top of the structure member at angles of 0° to 45°.

5. The mold device of claim 1, wherein the plurality of rib members are substantially parallel.

6. The mold device of claim 1, wherein rib members are attached at random points between the top and base of the structure member.

7. The mold device of claim 1, wherein the edge member extends inwardly from the interior surface at a downward angle from the horizontal.

8. The mold device of claim 1, wherein the edge member extends inwardly from the interior surface at an angle from 0° to 45° below the horizontal.

9. The mold device of claim 1, wherein the edge member is serrated.

10. The mold device of claim 1, wherein the inward extension of the edge member is intermittent along at least a portion of the base of interior surface of the mold cavity.

11. The mold device of claim 1, wherein the unitary structure member defines a plurality of mold cavities.

12. The mold device of claim 1, wherein the plurality of rib members, by their total dimension, define a total volume at least equal to the total volume defined by the protrusion of the edge member and the height and width of the portion of the interior wall above the edge member, less the total volume of the rib members.

13. The mold device of claim 1, wherein the defined mold cavity is oval.

14. The mold device of claim 1, wherein the defined mold cavity is circular.

15. The mold device of claim 1, wherein the rib members are polygonal in cross-section.

16. The mold device of claim 1, wherein the rib members are radial in cross-section.

17. The maid device of claim 1, wherein the rib members are triangular in cross-section.

18. The mold device of claim 1, wherein the rib members are truncated in cross-section.

19. The mold device of claim 1, wherein the cover structure has a bottom side configured so that the portion of the outer dimension conforming to the portion of the interior wall above the edge member is cut away to conform to the upper dimension of the edge member.

20. A mold device for producing a textured-face masonry unit, comprising:

a body having an inner perimeter established by a plurality of interconnected and vertically extending surfaces and which defines a three-dimensional cavity extending between an open top and an open bottom;

a plurality of ribs projecting from at least one of said surfaces of said body and extending a selected distance between said top and bottom;

an inwardly projecting edge located in proximity to said open bottom and extending a selected distance along said inner perimeter corresponding to a location of said ribs;

a support plate engageable against said bottom and defining an enclosed interior within said body for receiving a volume of a flowable masonry material; and a cover engageable with said open top, said cover including an outer perimeter configuration substantially matching said inner perimeter of said body;

vertical displacement of said cover through said body, concurrent with lowering of said support plate away from said body, causing said ribs to form a plurality of exterior facing voids in the masonry material, said edge member redirecting outermost portions of the material to fill at least a portion of the voids left by said ribs, texturing a corresponding outer face of the masonry material.

* * * * *